US010127888B2

(12) United States Patent
Wen et al.

(10) Patent No.: US 10,127,888 B2
(45) Date of Patent: Nov. 13, 2018

(54) LOCAL PIXEL LUMINANCE ADJUSTMENTS

(71) Applicant: Microsoft Technology Licensing, LLC, Redmond, WA (US)

(72) Inventors: Chien-Hui Wen, Redmond, WA (US); Ying Zheng, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 79 days.

(21) Appl. No.: 14/713,816

(22) Filed: May 15, 2015

(65) Prior Publication Data

US 2016/0335948 A1 Nov. 17, 2016

(51) Int. Cl.
*G09G 3/34* (2006.01)
*G09G 5/06* (2006.01)
(Continued)

(52) U.S. Cl.
CPC ..... *G09G 5/06* (2013.01); *G09G 3/3208* (2013.01); *G09G 3/3426* (2013.01);
(Continued)

(58) Field of Classification Search
CPC .. G09G 3/2085; G09G 3/2003; G09G 3/2074; G09G 3/2088; G09G 3/2092; G09G 3/3406; G09G 3/3413; G09G 3/342; G09G 3/3426; G09G 2330/021; G09G 2330/023; G09G 2340/0457; G09G 2320/0613; G09G 2320/062; G09G 2320/0646; G09G 2320/0673; G09G 2320/0686; G09G 3/3611; G09G 3/3208; G09G 2320/0626; G09G 2320/0271; G09G 2320/0285;
(Continued)

(56) References Cited

U.S. PATENT DOCUMENTS 7,113,164 B1 * 9/2006 Kurihara ..... G09G 3/3413 345/102
7,545,397 B2 * 6/2009 O'Dea ..... H04N 5/58 345/204
(Continued)

FOREIGN PATENT DOCUMENTS

WO 2003015066 A2 2/2003
WO 2014010949 A1 1/2014

OTHER PUBLICATIONS

PCT International Search Report and Written Opinion of the International Searching Authority dated Jul. 7, 2016 for corresponding PCT/US2016/028189.
(Continued)

*Primary Examiner* — Jason Mandeville
(74) *Attorney, Agent, or Firm* — Lempia Summerfield Katz LLC

(57) ABSTRACT

An electronic device includes a display and a processor coupled to the display. The display includes a plurality of zones distributed over a viewable display area. The processor is configured to (1) obtain source data for the image to be displayed in the viewable area of the display, (2) analyze the source data in selected zones of the plurality of zones to determine at least one characteristic of the image in each selected zone, and (3) adjust, separately in each zone of the plurality of zones, at least one type of subpixel in the subpixel matrix based on determined characteristics of the image in the selected, analyzed zones.

16 Claims, 5 Drawing Sheets

(51) Int. Cl.
*G09G 3/3208* (2016.01)
*G09G 3/36* (2006.01)

(52) U.S. Cl.
CPC ... *G09G 3/3611* (2013.01); *G09G 2300/0452* (2013.01); *G09G 2320/0271* (2013.01); *G09G 2320/0285* (2013.01); *G09G 2320/0626* (2013.01); *G09G 2320/0673* (2013.01); *G09G 2330/021* (2013.01); *G09G 2330/023* (2013.01); *G09G 2360/08* (2013.01); *G09G 2360/16* (2013.01); *G09G 2370/027* (2013.01)

(58) Field of Classification Search
CPC .. G09G 5/06; G09G 2360/08; G09G 2360/16; G09G 2370/027; G09G 2300/0452
USPC ..... 345/694, 102
See application file for complete search history.

(56) References Cited

U.S. PATENT DOCUMENTS 7,911,487 B2 3/2011 Brown Elliott et al.
7,925,254 B2 * 4/2011 Salo ..... H04N 7/163 370/271
8,018,476 B2 9/2011 Credelle et al.
8,350,799 B2 * 1/2013 Wasinger ..... G09G 3/3413 345/102
9,019,320 B2 * 4/2015 Yamazaki ..... G09G 3/3607 345/102
9,552,778 B2 * 1/2017 Lee ..... G09G 3/3406
2004/0145599 A1 * 7/2004 Taoka ..... G09G 3/20 345/698
2006/0125745 A1 * 6/2006 Evanicky ..... G09G 3/36 345/84
2008/0186272 A1 8/2008 Huang et al.
2011/0292018 A1 * 12/2011 Kubota ..... G09G 3/3426 345/211
2012/0044277 A1 2/2012 Adachi
2012/0154462 A1 6/2012 Hempson et al.
2012/0210274 A1 * 8/2012 Pettigrew ..... G09G 5/02 715/810
2012/0287167 A1 11/2012 Higgins et al.
2012/0287168 A1 11/2012 Botzas et al.
2013/0222221 A1 * 8/2013 An ..... G09G 3/3426 345/102
2013/0314448 A1 11/2013 Toksvig et al.
2014/0086448 A1 * 3/2014 Vaidya ..... G06K 9/621 382/103
2014/0361969 A1 12/2014 Wasinger et al.
2015/0325203 A1 * 11/2015 Ye ..... G09G 3/20 345/589
2016/0042680 A1 * 2/2016 Lin ..... G09G 3/2007 345/694
2016/0189619 A1 * 6/2016 Park ..... G09G 3/3258 345/690

OTHER PUBLICATIONS

Lai, et al., "Brightness Improvement of Color LCD Systems Using White Sub-pixel Structure and Fuzzy Mapping Algorithm", In IEEE Transactions on Consumer Electronics, Aug. 2007, pp. 1003-1010.
Pollack, Joel, "Pentile Display Response to Tested Blog", Published on: Jun. 15, 2011 Available at: http://pentileblog.com/tag/tablet/.
"Display Design and the Human Vision System", Published on: Dec. 29, 2008 Available at: http://www.nouvoyance.com/technology.html.
Greene, Kate., "A New Display Lengthens Gadget Life", Published on: Jun. 6, 2007 Available at: http://www.technologyreview.com/news/408015/a-new-display-lengthens-gadget-life/.
Zhang, et al., "Local Energy Pattern for Texture Classification Using Self-Adaptive Quantization Thresholds", Published in the Journal IEEE Transactions on Image Processing, vol. 22, Issue 1, Jan. 1, 2013, pp. 31-42.
"Second Written Opinion Issued in PCT Application No. PCT/US2016/028189", dated Apr. 25, 2017, 9 pages.
"International Preliminary Report on Patentability issued in PCT Application No. PCT/US2016/028189", dated Jun. 22, 2017, 10 pages.
Sonka, et al., "Image Processing, Analysis and Machine Vision: 3rd Edition", Published by Springer-Science+ Media, B.V., Jan. 1, 1993, pp. i-xix.

* cited by examiner

LOCAL PIXEL LUMINANCE ADJUSTMENTS

DESCRIPTION OF THE DRAWING FIGURES

For a more complete understanding of the disclosure, reference is made to the following detailed description and accompanying drawing figures, in which like reference numerals may be used to identify like elements in the figures.

Figure 1:
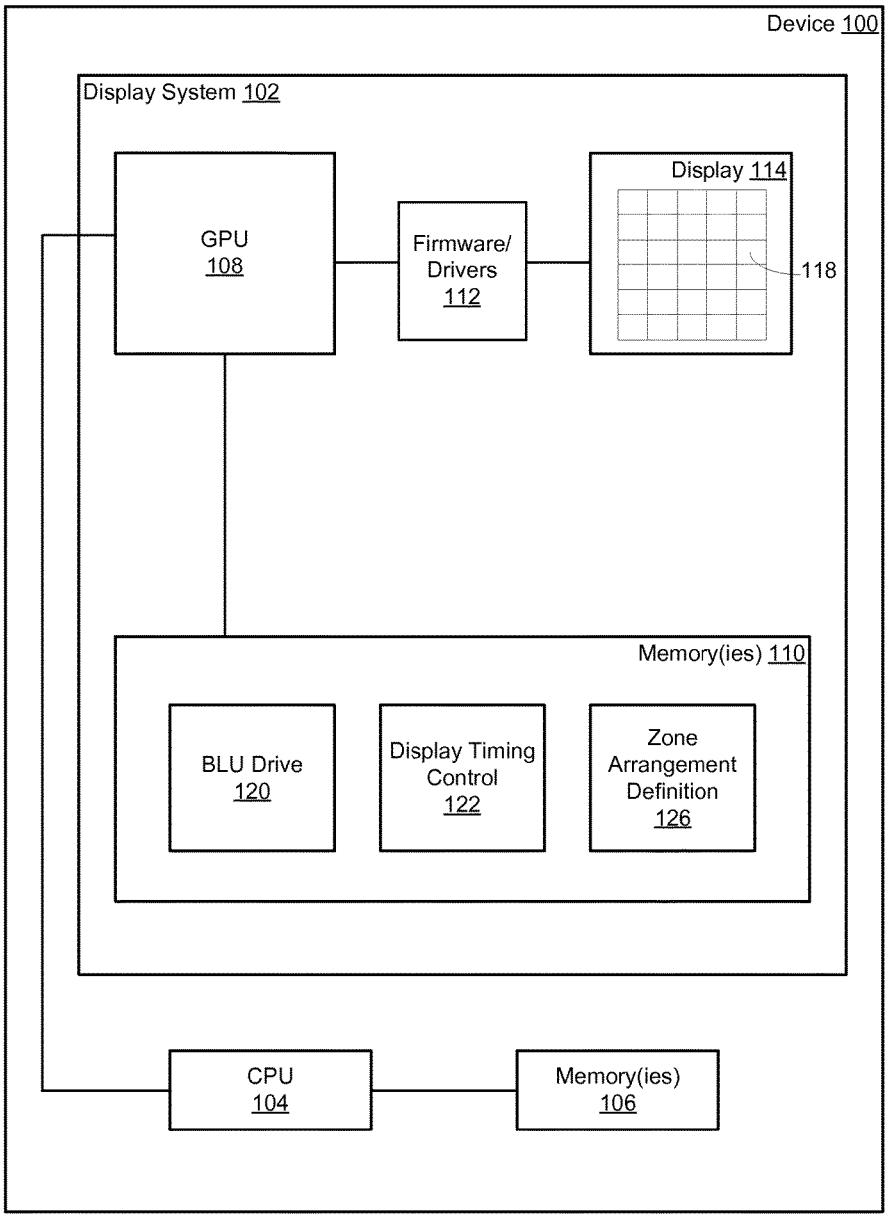
FIG. 1 depicts a block diagram of an electronic device with a configurable display for localized luminance in accordance with one example.

While the disclosed systems and methods are susceptible of embodiments in various forms, specific embodiments are illustrated in the drawing (and are hereafter described), with the understanding that the disclosure is intended to be illustrative, and is not intended to limit the invention to the specific embodiments described and illustrated herein.

DETAILED DESCRIPTION

Electronic devices include displays having an array of subpixels (e.g., pentile subpixels) distributed across a plurality of separately controlled zones or regions. Separate control of the zones may allow the luminous intensity or luminance to vary across the display. As used herein, "luminous intensity" or "intensity" may refer to the measure of wavelength-weighted power emitted by a light source in a particular direction per unit solid angle, expressed in candelas (cd). "Luminance" may refer to the measure of luminous intensity per unit area of light traveling in a given direction, expressed in candela per square meter (cd/$m^2$).

By varying the intensity from zone to zone within the display of the electronic device, overall power consumption for the electronic device may be reduced while the overall image quality may be retained or improved (as compared to an identical electronic device without separate luminance zone control).

Such power savings and performance retention/improvement may be accomplished through a dynamic analysis of source data for an image to be displayed. The analysis may be performed using a processor (e.g., a graphics processing unit (GPU)) of the electronic device, wherein the processor may analyze the source data for one or more characteristics of the image within each selected zone. Image characteristics include the gray level of the image, the content of the image, and/or the running application with each of the selected zones. Based on the determined characteristic(s) of the image, different adjustments may be made, in each zone, to at least one type of subpixel in each zone based on the determined characteristic. For example, the GPU may direct a display driver to adjust the intensity of specified subpixels in one zone of the display to a certain output (e.g., white subpixels at 100% ON), while adjusting the intensity of certain subpixels in an additional, separate zone to a different output (e.g., white subpixels at 0% ON).

In some examples, backlighting adjustments and/or gamma adjustments may also be made in selected zones. By controlling each zone of the display separately from each additional zone, the overall power consumption for the electronic device may be reduced while maintaining or improving the overall image quality.

Such a configuration may provide an improvement over conventional power reduction principles. For example, in certain pentile matrix configurations, four different color sub-pixels may be provided (e.g., red, green, blue, and white). The white pixel, without a color filter, may help boost display brightness and save on backlight power. When a white pixel is 100% ON, however, the displayed color may appear washed out. In order to overcome washed out issues, different algorithms can be employed to drive white pixel luminance. One example is to drive white pixel with different intensity based on the image background. For example, white pixel may be configured to be 100% ON when the image background is a webpage. When the image background displays saturated color, (e.g., yellow, red, green, or blue), the white pixel shut down to 0% to prevent color washed out. These colors may appear dull, however, since the luminance is 15% lower than a conventional RGB design.

Thus, through separate analysis of content in selected zones and separate control of subpixel intensity in each of the zones of the display, a power reduction in the device may be achieved while the image quality on the display of the electronic device is maintained/improved (e.g., the image is not washed out or dull). For example, instead of driving the white pixel to 100% in each zone, power may be driven to 100% in a fraction of the zones where necessary, while power may be driven to a reduced percentage (e.g., 0%) in other remaining zones. Less overall power may be consumed to produce the image, and the image quality may remain the same or may improve (as the image may no longer be washed out or dull).

The array of subpixels may be disposed on a film of the display. In some cases, organic light emitting diode (OLED) films are used. In other examples, the display is a liquid crystal display (LCD). The displays may have a suitable thickness for thin form factor devices (such as mobile phones, tablets, wearable devices, or other handheld electronic devices). Additionally, displays for larger form factor electronic devices are also possible. Examples of electronic devices include, but are not limited to, mobile phones, tablets, laptops, computer monitors, televisions, and other computing and non-computing devices having a display. The size of the display may range from the size of a handheld or wearable computing device to the size of a wall-mounted display or other large format display screen. In some cases, the display includes a touch-sensitive surface. The displays may or may not be associated with touchscreens. The electronic devices may or may not be battery powered.

Exemplary Configuration of Electronic Device

FIG. 1 depicts an electronic device 100 configured for localized luminance adjustments. The device 100 includes a display system 102 (or display module or subsystem). The display system 102 may be integrated with other components of the electronic device 100 to a varying extent. The display system 102 may be or include a graphics subsystem of the electronic device 100. Any number of display systems may be included. In this example, the device 100 also includes a processor 104 and one or more memories 106.

The display system 102 generates a user interface for an operating environment (e.g., an application environment) supported by the processor 104 and the memories 106. The processor 104 may be a general-purpose processor, such as a central processing unit (CPU), or any other processor or processing unit. Any number of such processors or processing units may be included.

The processing of the data and other aspects may be implemented by any combination of the processor 104, the processor 108, and/or one or more other processor(s), which may be collectively referred to as a processor. In other examples, the device 100 includes a single processor (i.e., either the processor 104, the processor 108, or a different processor) for purposes of obtaining and processing the image data.

The display system 102 may be communicatively coupled to the processor 104 and/or the memories 106 to support the display of video or other images via the user interface. In the example of FIG. 1, the processor 104 provides frame data indicative of each image frame of the images to the display system 102. The frame data may be generated by the processor 104 and/or by another component of the device 100. The frame data may be alternatively or additionally obtained by the processor 104 from the memory 106 and/or another component of the device 100.

In the example of FIG. 1, the display system 102 includes a graphics processor 108, one or more memories 110, firmware and/or drivers 112, and a display 114. The processor 108 may be a graphics processing unit (GPU) or other processor or processing unit dedicated to graphics- or display-related functionality. Some of the components of the display system 102 may be integrated. For example, the processor 108, one or more of the memories 110, and/or the firmware 112 may be integrated as a system-on-a-chip (SoC) or application-specific integrated circuit (ASIC). The display system 102 may include additional, fewer, or alternative components. For example, the display system 102 may not include a dedicated processor, and instead rely on the CPU or other processor 104 that supports the remainder of the electronic device 100. The display system 102 may not include the memory (or memories) 110, and instead use the memories 106 to support display-related processing. In some cases, instructions implemented by, and data generated or used by, the processor 108 of the display system 102 may be stored in some combination of the memories 106 and the memories 110.

The display 114 includes a light emitting device such as a liquid crystal display (LCD) or a light emitting diode (LED) (e.g., an organic light emitting diode (OLED)). The LCD or LED may be disposed in, or configured as, a film. The configuration, construction, materials, and other aspects of the light emitting devices may vary. For instance, III-V semiconductor-based LED structures may be used to fabricate micron-sized LED devices. The small thickness of such structures allows the light emitting devices to be disposed in planar arrangements (e.g., on or in planar surfaces) and thus, distributed across the viewable area of the display. Non-LED technologies, such as finely tuned quantum dot-based emission structures, may also be used. Other thin form factor emission technologies, whether developed, in development, or future developed, may be used.

The light emitting device of the display 114 may include an array of pixels (including a plurality of subpixels) to display the various colors of an image. The subpixels may be arranged in a pentile matrix scheme having a repeating pattern of subpixels, or an alternating pattern of subpixels adjacent to a differently arranged pattern of subpixels. Additional alternating patterns of subpixels may also be provided within the pentile matrix scheme. The number of subpixels within the pentile matrix scheme is variable, and may include four or five subpixels, for example.

Use of a pentile matrix scheme may provide for the use of fewer subpixels than a traditional RGB scheme while maintaining a measured luminance display resolution. In the context of a LCD-type display, use of white subpixel (provided through unfiltered backlight) may provide a brighter image in comparison to an RGB-matrix while using the same amount of power, or produce an equally bright image while using less power.

In the case of an OLED-type display, the subpixels may be arranged within an organic layer. In the case of a LCD-type display, the subpixels may be arranged as part of a color filter layer, which operates in combination with a backlight. In certain examples, the pattern of subpixels (e.g., in the organic layer or the color filter layer) includes primary colors red (R), green (G), and blue (B) for three of the subpixels. The remaining two subpixels may be repeated primary colors. In other examples, at least one additional subpixel may be a secondary color such as cyan (C), magenta (M), or yellow (Y). In some examples, such as in the case of an LCD-type display having a backlight, one of the subpixels may be clear or have no color filter material to provide white (W) color from the backlight. Therefore, in certain examples, the subpixels in a pentile matrix may include four subpixels with the following pattern: RGBX, wherein X=R, G, B, C, M, Y, or W. In an alternative example, the subpixels in the pentile matrix may include five subpixels with the following pattern: RGBXZ, wherein X=R, G, B, C, M, Y, or W, and Z=R, G, B, or X.

The pentile matrix scheme of the display 114 may be arranged in a plurality of zones 118 (or regions). The arrangement and number of zones 118 may be configurable. The configurability of the zone arrangement may specify the shape, size, orientation, position, and/or other parameters of the zones 118.

The zones 118 may be arranged in an array as depicted in FIG. 1 (or FIG. 2, discussed in greater detail below). In one example, the zones 118 are arranged in a number of contiguous rows and columns. The rows and columns may or may not be oriented along the vertical and horizontal axes of the viewable area. In some cases, the configurability of the zone arrangement may be relative to the pixel array. The array of pixels in each zone may vary from zone to zone. For example, the zone arrangement may be configurable to dispose a specified number of pixels in each zone 118. The boundaries of the zones 118 may thus be configurable.

The processor 108 may be configured to obtain source data for an image to be displayed in the viewable area of the display 114. The processor may analyze, for each zone 118 or for a selected number of zones, the source data or image to be displayed. The analysis may include determining one or more characteristics of the image such as (1) the gray level of the image in each zone, (2) the content of the image in each zone, (3) the application being run in each zone, or (4) combinations thereof.

Gray level analysis of an image may be conducted to determine the amount of saturated color within a selected zone 118 of the display 114. In such an analysis, the processor 108 may be configured to analyze the source data or image to be displayed in each selected zone 118 and develop a gray-scale histogram of the image in each selected zone. The histogram represents a distribution of the pixels in the image over the gray-level scale for the selected zone. The histogram may be visualized as if each pixel is placed in a bin corresponding to the color intensity of that pixel. All of the pixels in each bin are added up and displayed on a graph, where the graph represents a histogram of the image within the particular zone. The histogram may be a key tool in image processing and analysis, as it is useful in viewing the contrast of an image in each selected zone of the display 114. For example, if the gray-levels are concentrated near a certain level, the image in the zone may be identified as a low contrast image. Likewise, if the gray-levels are well spread out, it may define a high contrast image for the zone.

In the gray-scale analysis, an algorithm may be run to compare the created histogram information with information retrieved from one of the memories 106, 110 of the device 100. The comparison of data may be useful in determining what output to send to a display driver to adjust the subpixel luminous intensity for each zone 118 of the display 114. For example, each histogram may be individually compared using an appropriate algorithm stored within the system-on-a-chip or the display timing control to assist in driving the display with optimized color, gamma, backlight, and/or pixel structure in each zone. Specifically, each histogram may be individually compared with one or more lookup tables stored within one of the memories (e.g., the display timing control 122). Through a matching of histogram data with lookup table data, a determination may be made on what image rendering information is provided to a display driver 112 and display 114. Lookup tables may provide savings in term of processing time that may be significant, as retrieving potential image rendering information from memory may be faster than undergoing a computation for what image rendering information to send to the display driver 112 on a case-by-case basis.

For example, for one particular zone, an analyzed gray level histogram is compared and matched with a lookup table from the memory of the device. Based on the comparison, the lookup table may help instruct the processor and display driver to drive white subpixels at 50% within the zone. Alternatively, the red, blue, and green subpixels within the zone may be driven at a certain percentage (particularly if no white subpixel is provided). In yet other examples, a secondary color subpixel (e.g., yellow) may be driven within the zone at a predetermined power output based on the analysis and comparison with the lookup table.

In other examples, the processor 108 may be configured to analyze the content of the image/source data to be displayed in each selected zone 118. In other words, an algorithm may be run to determine the content of the image in a selected zone. The content-based analysis may search for colors, shapes, textures, additional information that may be derived from the image itself, and combinations thereof. A content-based analysis may be desirable because such an analysis does not rely purely on metadata from the source data that may be dependent on annotation quality or completeness. In other words, metadata may not necessarily be provided or accurately define the type of image provided.

Content-based analysis of the color of the image within a zone may be achieved by computing a color histogram for the selected zone, where the histogram identifies the proportion of pixels within an image having specific color values. Examining images based on the colors they contain is a widely used technique because the analysis may be completed without regard to image size or orientation.

An analysis of the shape does not refer to the shape of an image but to the shape of a particular region that is being examined within a particular zone. Shapes may be determined first applying a segmentation or edge detection to an image within the zone. Other shape-based analyses may use shape filters to identify given shapes of an image.

Texture-based analyses may look for visual patterns in images within a zone and determined how the images are spatially defined. Textures are represented by texels that are placed into a number of sets, depending on how many textures are detected in the image. These sets not only define the texture, but also where in the image the texture is located. The identification of specific textures in an image may be achieved by modeling texture as a two-dimensional gray level variation. The relative brightness of pairs of pixels is computed such that degree of contrast, regularity, coarseness, and directionality may be estimated. The problem is in identifying patterns of co-pixel variation and associating them with particular classes of textures such as silky, or rough.

In the content-based analysis, an algorithm may be run to compare the identified information (e.g., a color histogram, identified shapes or textures) with information retrieved from one of the memories 106, 110 of the device 100. Like the gray-scale comparison described above, the content-based comparison of data may be useful in determining what output to send to a display driver to adjust the subpixel luminous intensity for each zone 118 of the display 114. For example, a color histogram, shape, or texture may be compared with one or more lookup tables or databases stored within the memory of the device (e.g., a display timing control 122 memory). Through a matching of the collected color histogram data or identified shapes and textures with a lookup table data or database, a determination may be made on what image rendering information is provided to a display driver 112 and display 114. As identified above, lookup tables and databases may provide savings in term of processing time that may be significant, as retrieving potential image rendering information from memory may be faster than undergoing a computation for what image rendering information to send to the display driver 112 on a case-by-case basis.

For example, for one particular zone, an analyzed color level histogram is compared and matched with a lookup table from the memory of the device. Based on the comparison, the lookup table may help instruct the processor and display driver to drive white subpixels at 75% within the zone. Alternatively, the red, blue, and green subpixels within the zone may be driven at a certain percentage (particularly if no white subpixel is provided). In yet other examples, a secondary color subpixel (e.g., yellow) may be driven within the zone at a predetermined power output based on the analysis and comparison with the lookup table.

In another example, for one zone, an identified shape or texture within the image may be matched with a particular shape or texture in a database or lookup table. Based on the preciseness of the match, the database may help instruct the processor and display driver to drive specified subpixels to a certain output or luminance within the zone.

In yet other examples, for each analyzed zone, the content-based analysis may combine more than one of the color, shape, and texture analyses. More than one lookup table or database may be analyzed in the comparison. In such an analysis, a weighted output may be provided to the processor and display driver on how to drive the subpixels within the zone. For example, the lookup table or database for a color analysis may suggest driving white subpixels within the zone at 75% ON, while a separate database for the shape or texture analysis may suggest driving white subpixels within the zone at 50% ON. The two may be averaged together with equal weight (e.g., 0.5*Color+0.5*Shape) to provide a suggested power to the white subpixels of 62.5% ON. Alternatively, one analysis may be given more weight than the remaining analyses (e.g., the color-based analysis may be weighted heavier, 0.75*Color+0.25*Shape), to provide suggested power to the white subpixels of 68.75%.

In yet other examples, the processor 108 may be configured to analyze the source data or image to be displayed in each selected zone 118 based on the application or program being run. In other words, an algorithm may be run to determine the application being run in a selected zone of the display (e.g., Word, Internet Explorer, Windows Media Player). The application-based analysis may search for metadata within the source data of the image to be displayed. In one example, the analysis may identify a ".doc" or ".docx" extension and associate the image within the zone of the display to be a Word document. In another example, the analysis may identify a ".wmv" extension and associate the image within the zone to be a movie or video file.

Specific patterns or image outputs may be associated with the application and stored within a memory 106, 110 of the device 100. Therefore, in the application-based analysis, an algorithm may be run to compare the identified information with information retrieved from one of the memories 106, 110 of the device 100. Like the gray-scale or content-based comparison described above, the application-based comparison of data may be useful in determining what output to send to a display driver to adjust the subpixel luminous intensity for each zone 118 of the display 114. For example, a Word document or web browser application may include a majority of white background content, and therefore requiring zones displaying the content to include white subpixels driven at 100% ON. Video or movie files may be the opposite, having more dark or black background content (therefore requiring a different output, such as driving the white subpixels at 0% or 25% ON, for example).

Through a matching of the application with a lookup table data or database, a determination may be made on what image rendering information is provided to a display driver 112 and display 114. As identified above, lookup tables and databases may provide savings in term of processing time that may be significant, as retrieving potential image rendering information from memory may be faster than undergoing a computation for what image rendering information to send to the display driver 112 on a case-by-case basis.

In certain examples, the imaging rendering characteristics may be generated from more than one analysis. For example, more than one of a gray-level histogram analysis, a content-based analysis, and an application-based analysis may be combined. In such an analysis, a weighted output may be calculated and provided to the processor and display driver on how to drive at least one type of subpixel within the zone. For example, the weighted analysis may have the following formula for driving a specific subpixel (e.g., white subpixel) within an identified zone:

$$\text{Subpixel power (\% ON)} = x^{*}\text{Gray-Level (\%)} + y^{*}\text{Content (\%)} + z^{*}\text{Application (\%)}$$

where $x+y+z=1$.

For example, a gray-level histogram analysis may suggest driving white subpixels within the zone at 75% ON, the content-based analysis may suggest driving white subpixels within the zone at 50% ON, and the application-based analysis may suggest driving white subpixels within the zone at 25% ON. The three analyses may be averaged together with equal weight (e.g., $x=y=z=0.33$) to provide a suggested power to the white subpixels of 50% ON. Alternatively, one analysis may be given more weight than the remaining analyses (e.g., the gray-level analysis may be weighted heavier (e.g., $x=0.5$, $y=z=0.25$), to provide suggested power to the white subpixels of 56.25%.

In other examples, a gray-level histogram analysis may be skipped ($x=0$) if a content or application analysis returns identifiable information on the content of the image or the application being run within the selected zone of the display 114. Skipping over a gray-level analysis may be beneficial in conserving processing power and/or increasing image rendering speed for the device 100.

In certain examples, in order to save on processing power and time, only a selected number of zones of the plurality of zones 118 are analyzed. For instance, every other zone may be analyzed. In one example, the display 114 may be divided into eight equal zones. In another example, the same-sized display 114 may be divided into thirty-two smaller zones. With smaller zones, the image may be analyzed and fine-tuned to a greater degree. The potential drawback, however, is that the more power may be consumed by the GPU to analyze the image data in each of the thirty-two separate zones. To overcome this potential power consumption problem, the source data may not be analyzed in each of the zones. Instead, source data or image content may be analyzed in every other zone, and an average value or output is provided for the non-analyzed zones in between. Through this process, image quality may be maintained with low power consumption and without a full analysis of each zone of an image to be displayed.

Following analysis of the source data, a processor (e.g., GPU 108) may determine how to adjust the subpixels in each zone based on the analyzed characteristics of the source data. The processor unit 108 may determine how the subpixels within each zone of the display 114 are driven to display the image. This may provide an improved or power-saving image output. Each zone may be separately controlled from adjacent zones of the display 114. As such, subpixels in each zone may be adjusted or driven differently from subpixels in adjacent zones. Through this analysis and control of the subpixels, the overall image may be rendered using less power and/or provide an improved image.

In this processing, an algorithm may be run by the processing unit 108 to determine how subpixels are driven or adjusted in each zone. In certain examples, in each zone, the power provided to at least one type of subpixel may be adjusted to alter the subpixel luminous intensity within the zone. In some examples, the intensity of the white subpixel is adjusted separately in each zone. In other examples, the intensity of one or more of the primary color subpixels (e.g., the red, blue, and green subpixels) is adjusted separately in each zone. All three primary subpixels may be collectively adjusted to indirectly adjust white color within the zones. This collective adjustment may be considered where a white subpixel is not present in the pentile matrix (e.g., a display without a backlight providing white light such as a LED-type unit). In other examples, power driven to a secondary color subpixel (e.g., cyan, magenta, yellow) may be adjusted within one or more zones.

This departmentalized calculation of power driven to at least one type of subpixel for the plurality of zones differs from a conventional pentile design, wherein only one subpixel power (e.g., white subpixel power) may be provided for the entire viewable image. Unlike the conventional design, this example provides how at least one type of subpixel in multiple zones may be driven dynamically, wherein power may vary from zone to zone between 0-100% with fine details. Such zone-by-zone control allows for power savings to the device while maintaining or improving the displayed image quality. For example, the image to be displayed may have several zones identified with high saturation and several additional zones identified with low saturation. The white subpixel in the high saturation zones may be powered at 100% while the white subpixel in the low saturation zones may be powered at 0%. This provides a power savings over a conventional design where the entire image may have had the white subpixel driven at 100% ON. Additionally, this example may provide an improved image, as driving all of the white subpixels for the entire image at 100% may lead to a washed-out image, particularly in the zones of the image with low saturation.

In addition to adjusting the intensity or power driven to the color subpixels, gamma adjustments and/or backlight adjustments may also be made to each zone. Gamma corrections/adjustments of subpixels may be used to optimize the usage of bits when encoding an image, or bandwidth used to transport an image, by taking advantage of the non-linear manner in which humans perceive light and color. Human vision, under common illumination conditions (i.e., not pitch black nor blindingly bright), follows an approximate gamma or power function, with greater sensitivity to relative differences between darker tones than between lighter tones. If subpixels are not gamma-adjusted, the images may allocate too many bits or too much bandwidth to highlights that humans cannot differentiate, and too few bits or bandwidth to shadow values that humans are sensitive to and would require more bits or bandwidth to maintain the same visual quality. Altering the subpixels through a gamma-correction may cancel this nonlinearity, such that the output image has the intended luminance. The gamma correction may follow a power-law relationship. In certain examples, the intensity of the subpixels within a zone may be adjusted by a gamma correction exponent (y) of 2.2 or the inverse exponent (1/y) of 0.45. The exponent of 0.45 may be used to convert linear intensity into lightness for neutral colors, while the correction exponent of 2.2 may be used to adjust grays.

Regarding backlight corrections, the display 114 may include a backlight configured to provide backlighting (e.g., white backlight). The processor 108 may be coupled to a backlight to control the backlight intensity or brightness level in each zone 118. The processor 108 may be coupled to the backlight via the firmware and/or drivers 112. One or more drivers may be stored in, and made available via, the firmware 112. In other cases, the processor 108 is directly connected to the backlight. For example, the backlight may include an interface responsive to control signals generated by the processor 108. Alternatively, an interface is provided via the firmware/drivers 112 and/or another component of the display system 102 that is not integrated with the backlight.

In the example of FIG. 1, the processor 108 is configured in accordance with backlight unit (BLU) drive instructions 120 stored in the memories 110. The BLU drive instructions 120 may direct the processor 108 to control the brightness level of the planar emission devices in each zone separately from other planar emission devices in the other zones 118. When a single zone includes multiple planar emission devices, each of the planar emission devices in the respective zone may be driven at a common brightness level. Alternatively or additionally, the multiple planar emission devices may be driven at respective, individual brightness levels that together combine to establish a desired collective brightness level for the zone 118.

Each planar emission device may be configured to emit white light. In some cases, the brightness of each backlight emission device may depend, in turn, on the intensities of the respective colors present in the image to be displayed. With the capability to address each color plane (or other color emission device) individually, further power savings may be achieved.

The processor 108 may be configured to control the brightness level for each zone. For example, the processor 108 may analyze the image data within a selected zone to determine the brightness level of the planar emission devices disposed in the backlight zone arrangement. In some cases, the image data for each zone 118 is processed separately from the image data for other zones 118. The brightness level may thus be determined for each respective zone without having to process the frame data for the entire viewable area of the display system 102. Instead, the brightness level for each zone 118 is based on frame data local to the respective zone 118, rather than global frame data for the entire viewable area.

The BLU drive instructions 120, the display timing control instructions 122, and the zone arrangement definition 126 may be arranged in discrete software modules or instruction sets in the memories 110. Alternatively, two or more of the instructions or definitions 120, 122, 126 may be integrated to any desired extent. The instructions or definitions 120, 122, 126 may alternatively or additionally be integrated with other instructions, definitions, or specifications stored in the memories 110. Additional instructions, modules, or instruction sets may be included. For instance, one or more instruction sets may be included for processing touch inputs in cases in which the display system 102 includes a touchscreen or other touch-sensitive surface.

In certain examples, each zone adjustment may be based on a combination of adjusting intensity of the subpixels, gamma adjustments, and backlight adjustments. The zone adjustment may be based on a weighted analysis of these three factors to provide an overall power output to each individual zone. In such an analysis, a weighted output may be calculated and provided to the processor and display driver on how to drive power to the zone.

Figure 2:
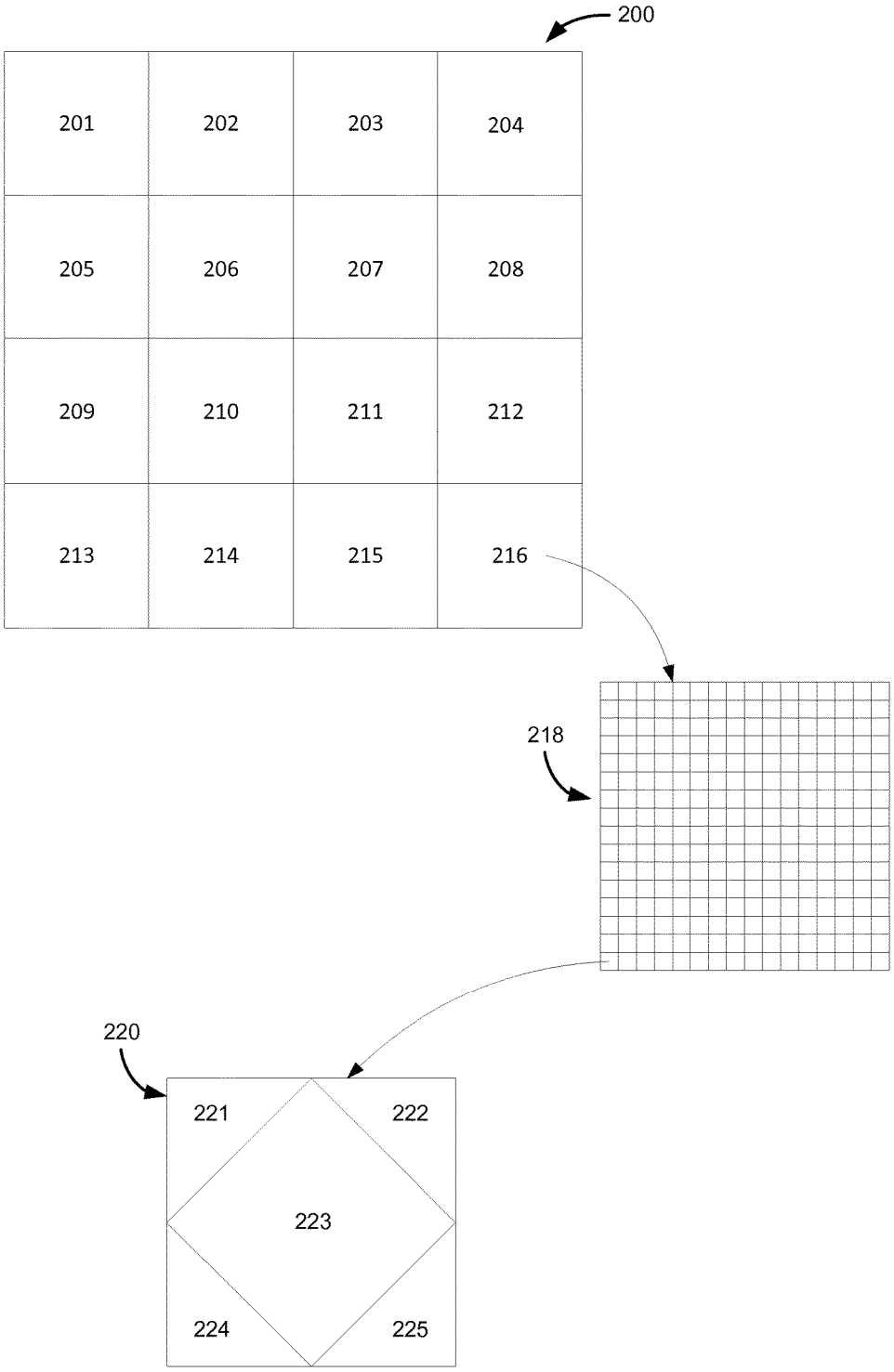
FIG. 2 depicts a schematic view of an arrangement of a plurality of zones and pixel arrangements of a display in accordance with one example.

FIG. 2 depicts one example of a zone arrangement 200 of the display. In this example, the zone arrangement 200 is a square-shaped area covering the viewable area of a display. The viewable area depicts a plurality of equally-sized zones 201-216, although the number of zones in the display may be variable. Additionally, each zone may or may not be the same size or include the same number of pentile subpixels. In certain examples, such as depicted in FIG. 2, the zones 201-216 within the zone arrangement 200 are oriented with the horizontal-vertical orientation of the display and array of pixels. In other examples, the zone arrangement may be oriented differently than the orientation of the display pixels, which may be done to minimize boundary conditions. In certain examples, the zone arrangement may be oriented in a manner other than a horizontal-vertical orientation of the display pixels. For instance, the zone arrangement may have boundaries oriented diagonally. Other zone boundary shapes may be used in addition or alternative to the diamond-shaped zones. The shapes may be non-rectilinear shapes despite the rectilinear shape of the viewable area. For example, the zone arrangement may include triangular or hexagonally shaped zones.

Each zone within the zone arrangement includes an array of pixels. As depicted in FIG. 2, zone 216 has been expanded to depict an example of an array of pixels within the zone. The array of pixels may be formed from an arrangement or matrix of pentile subpixels.

FIG. 2 depicts one example of a pentile subpixel arrangement 220. Within the arrangement, five subpixels 221-225 are provided. In this example, a center diamond subpixel 223 is surrounded by four corner triangle subpixels 221, 222, 224, 225.

In certain examples, the pattern of subpixels includes primary color filters for the four triangle subpixels (e.g., RBGB, RGBG, RGBR) and the center diamond subpixel has no filter. In combination with a backlight, the center diamond subpixel provides a white light. In other examples, the unfiltered white subpixel is provided in one or two corner triangle subpixels. In yet other examples, a secondary color filter is provided at any one of the five subpixels in combination with the primary color filters.

In other examples, the pattern of subpixels are part of an organic layer within a LED display, wherein the color pattern is RGBXZ, where X is R, G, B, C, M, or Y, and Z is R, G, B, or X.

As discussed above, with reference to FIG. 1, a processor may analyze each of zones 201-216 in FIG. 2 to determine a characteristic of the image in each zone. In certain examples, only a selected number of zones less than every zone may be analyzed. For instance, every other zone may be analyzed (e.g., zones 201, 203, 206, 208, 209, 211, 214, and 216 are analyzed) to determine at least one characteristic of the image contained in each of the selected eight zones. Following the analysis of the images, the subpixels in each zone of the sixteen total zones may be adjusted based on the determined characteristic of the images in the eight analyzed zones. The subpixels within zone 201 are adjusted based on the analyzed characteristic(s) of zone 201. The same is true for zone 203. Regarding zone 202, located between zones 201 and 203, the subpixels may be adjusted based on the average of the adjustments made to zones 201 and 203.

In one example, for unanalyzed zone 207, the subpixels within the zone may be adjusted based on an average of two or more analyzed adjacent zones 203, 206, 208, and/or 211. For example, at least one type of subpixel within zone 207 may be powered based on the average subpixel power in adjacent zones 203 and 211; zones 206 and 208; zones 203 and 206; zones 203 and 208; zones 208 and 211; zones 203, 206, and 208; zones 206, 208, and 211; zones 203, 208, and 211; zones 203, 206, and 211; or zones 203, 206, 208, and 211. In this example, the analyzed source data in zones 203 and 208 is mostly black, while the data in zones 206 and 211 includes a high percentage of yellow saturated color. As such, zones 203 and 208 may have the white subpixel driven at 0% ON, while white subpixels for zones 206 and 211 are driven at 75% ON. If the power to zone 207 is based on an average of zones 203 and 211, for example, the power to the white subpixel in zone 207 would be 38% ON.

As previously noted, this control differs from a conventional pentile design, wherein only one white subpixel power is provided for the entire image. Unlike conventional design, this example provides how at least one type of subpixel in multiple zones may be driven dynamically, wherein power may vary from zone to zone between 0-100% with fine details.

Figure 3A:
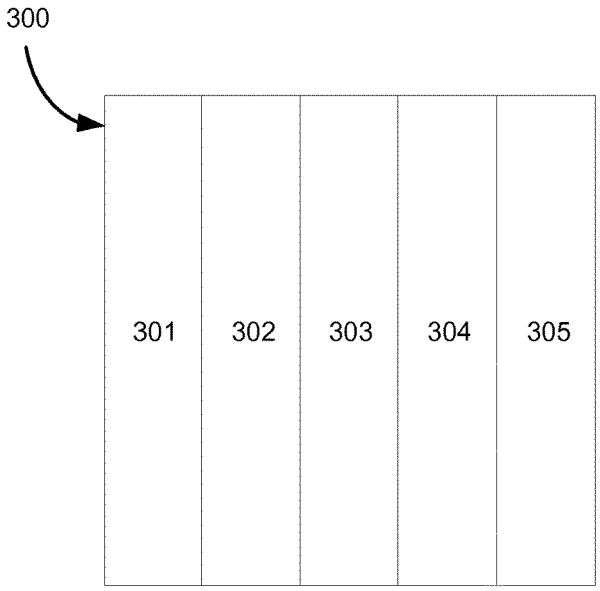
FIGS. 3A and 3B depict examples of pentile subpixel arrangements.
Figure 3B:
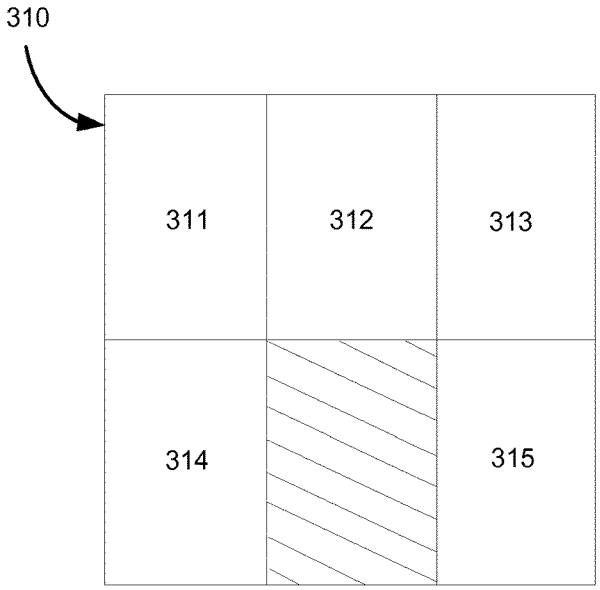

FIGS. 3A and 3B depict non-limiting examples of alternative pentile subpixel arrangements. In FIG. 3A, the five subpixels 301-305 are arranged side-by-side. Although each subpixel is depicted within FIG. 3A to have the same dimensions, the height and width of each subpixel is not necessarily limited to such an arrangement. For example, the width of one or more subpixels may be larger than the remaining subpixels. Additionally, the height of one or more subpixels may be larger than the remaining subpixels.

In FIG. 3B, the five subpixels 311-315 are arranged in two rows and three columns. In the second row, a blank area (delineated by a series of diagonal lines) does not contain a subpixel. Instead, the area may provide a location for circuitry for the subpixel matrix.

The color filters or organic layer arrangement for the examples in FIGS. 3A and 3B may be similar to those described above for the pentile subpixel arrangement 220 in FIG. 2.

Exemplary Method for Localized Luminance Adjustments

Figure 4:
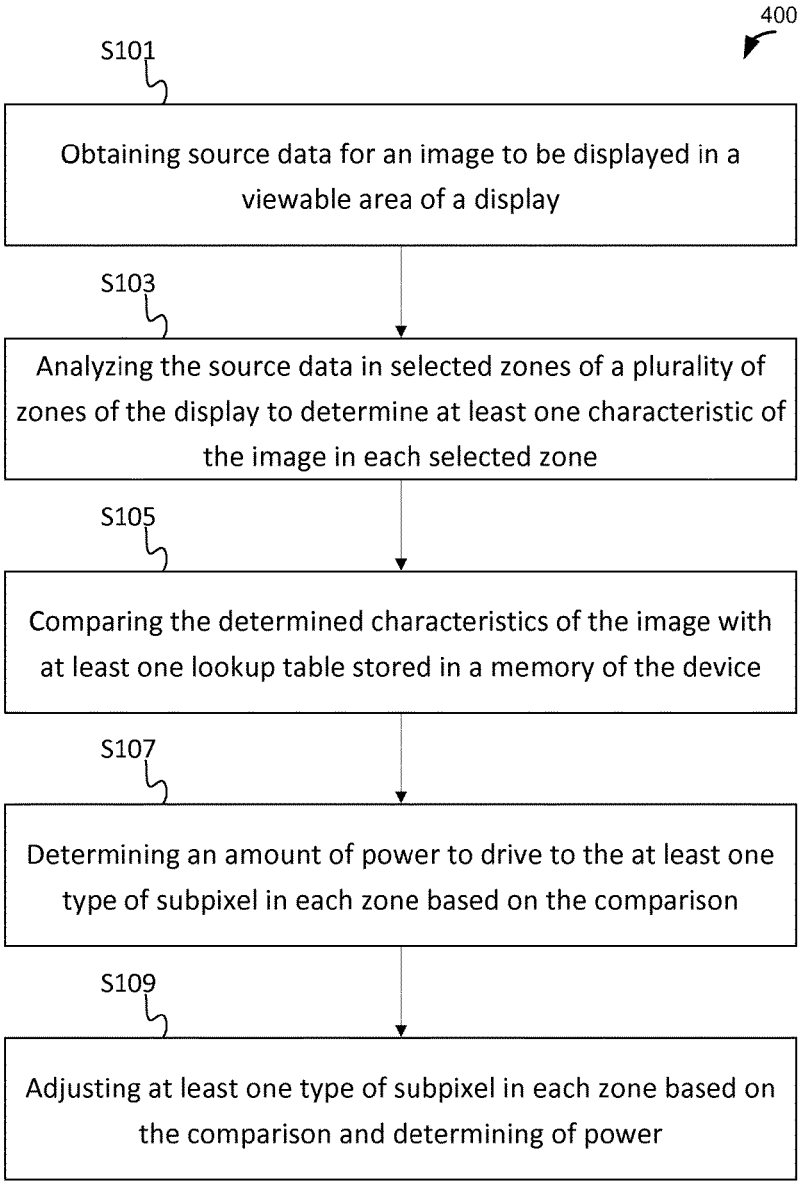
FIG. 4 is a flow diagram of a computer-implemented method of operating an electronic device having a display with a configurable backlight for localized backlighting in accordance with one example.

FIG. 4 depicts an exemplary method 400 for localized pixel luminance adjustments. The method 400 is computer-implemented. For example, one or more computers of the electronic device 100 depicted in FIG. 1 and/or another electronic device may be configured to implement the method or a portion thereof. The implementation of each act may be directed by respective computer-readable instructions executed by the processor 108 (FIG. 1) of the display system 102 (FIG. 1), the processor 104 (FIG. 1) of the device 100, and/or another processor or processing system. Additional, fewer, or alternative acts may be included in the method 400.

At act S101, source data for an image to be displayed in a viewable area of a display is obtained or retrieved using a processor of an electronic device. The display may be divided into a plurality of zones for further analysis.

At act S103, the source data in selected zones of the plurality of zones is analyzed to determine at least one characteristic of the image in each selected zone. The at least one characteristic of the image may include, for each selected zone, a gray level histogram of the image, content of the image, an application being run, or a combination thereof. In certain examples, the content of the image includes a color histogram of the image, an identified shape of the image, an identified texture of the image, or a combination thereof.

At act S105, the determined characteristics of the image may be compared with at least one lookup table stored in a memory of the electronic device.

At act S107, based on the comparison, an amount of power to drive one or more types of subpixels within each zone is determined.

At act S109, at least one type of subpixel is adjusted for each zone of the plurality of zones based on determined characteristics of the image in the selected, analyzed zones and comparison with the lookup table. In certain examples, adjustments may be made to at least one type of subpixels in unselected, unanalyzed zones of the plurality of zones by an average of the adjustments made to two or more adjacent, selected and analyzed zones.

Exemplary Computing Environment

Figure 5:
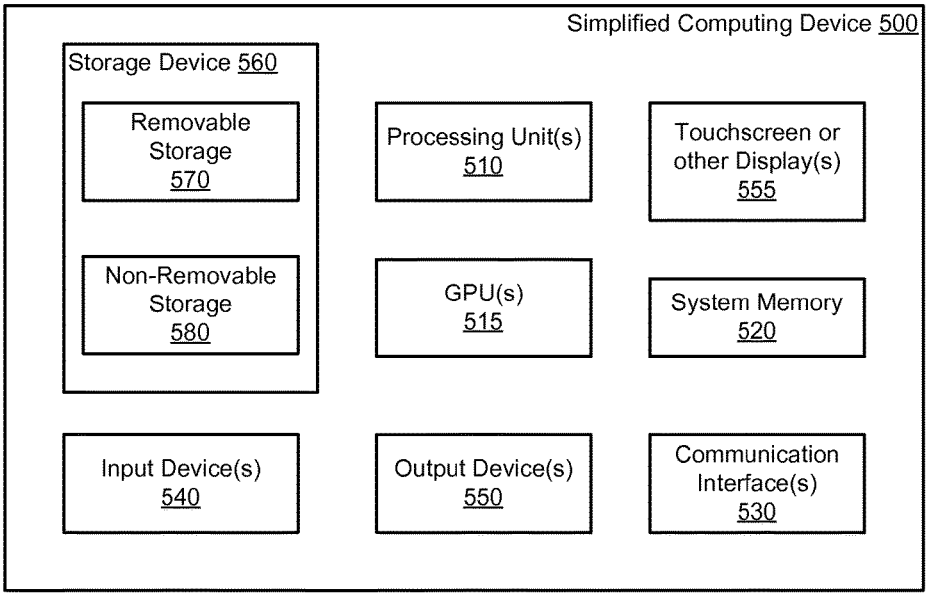
FIG. 5 is a block diagram of a computing environment in accordance with one example for implementation of the disclosed methods and systems or one or more components or aspects thereof.

With reference to FIG. 5, an exemplary computing environment 500 may be used to implement one or more aspects or elements of the above-described methods and/or systems and/or devices. The computing environment 500 may be used by, incorporated into, or correspond with, the electronic device 100 (FIG. 1) or one or more elements thereof. For example, the computing environment 500 may be used to implement one or more elements of the electronic device 100. In some cases, the display system 102 (FIG. 1) may be incorporated into the computing environment 500.

The computing environment 500 may be a general-purpose computer system or graphics- or display-based subsystem used to implement one or more of the acts described in connection with FIG. 4. The computing environment 500 may correspond with one of a wide variety of computing devices, including, but not limited to, personal computers (PCs), server computers, tablet and other handheld computing devices, laptop or mobile computers, communications devices such as mobile phones, multiprocessor systems, microprocessor-based systems, set top boxes, programmable consumer electronics, network PCs, minicomputers, mainframe computers, or audio or video media players. In certain examples, the computing device may be a wearable electronic device, wherein the device may be worn on or attached to a person's body or clothing. The wearable device may be attached to a person's shirt or jacket; worn on a person's wrist, ankle, waist, or head; or worn over their eyes or ears. Such wearable devices may include a watch, heart-rate monitor, activity tracker, or head-mounted display.

The computing environment 500 has sufficient computational capability and system memory to enable basic computational operations. In this example, the computing environment 500 includes one or more processing unit(s) 510, which may be individually or collectively referred to herein as a processor. The computing environment 500 may also include one or more graphics processing units (GPUs) 515. The processor 510 and/or the GPU 515 may include integrated memory and/or be in communication with system memory 520. The processor 510 and/or the GPU 515 may be a specialized microprocessor, such as a digital signal processor (DSP), a very long instruction word (VLIW) processor, or other microcontroller, or may be a general purpose central processing unit (CPU) having one or more processing cores. The processor 510, the GPU 515, the system memory 520, and/or any other components of the computing environment 500 may be packaged or otherwise integrated as a system on a chip (SoC), application-specific integrated circuit (ASIC), or other integrated circuit or system.

The computing environment 500 may also include other components, such as, for example, a communications interface 530. One or more computer input devices 540 (e.g., pointing devices, keyboards, audio input devices, video input devices, haptic input devices, or devices for receiving wired or wireless data transmissions) may be provided. The input devices 540 may include one or more touch-sensitive surfaces, such as track pads. Various output devices 550, including touchscreen or touch-sensitive display(s) 555, may also be provided. The output devices 550 may include a variety of different audio output devices, video output devices, and/or devices for transmitting wired or wireless data transmissions.

The computing environment 500 may also include a variety of computer readable media for storage of information such as computer-readable or computer-executable instructions, data structures, program modules, or other data. Computer readable media may be any available media accessible via storage devices 560 and includes both volatile and nonvolatile media, whether in removable storage 570 and/or non-removable storage 580.

Computer readable media may include computer storage media and communication media. Computer storage media may include both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may accessed by the processing units of the computing environment 500.

The localized backlighting techniques described herein may be implemented in computer-executable instructions, such as program modules, being executed by the computing environment 500. Program modules include routines, programs, objects, components, or data structures that perform particular tasks or implement particular abstract data types. The techniques described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices.

The techniques may be implemented, in part or in whole, as hardware logic circuits or components, which may or may not include a processor. The hardware logic components may be configured as Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), and/or other hardware logic circuits.

The technology described herein is operational with numerous other general purpose or special purpose computing system environments or configurations. Examples of well-known computing systems, environments, and/or configurations that may be suitable for use with the technology herein include, but are not limited to, personal computers, hand-held or laptop devices, mobile phones or devices, multiprocessor systems, microprocessor-based systems, set top boxes, programmable consumer electronics, network PCs, minicomputers, mainframe computers, distributed computing environments that include any of the above systems or devices.

The technology herein may be described in the general context of computer-executable instructions, such as program modules, being executed by a computer. Generally, program modules include routines, programs, objects, components, data structures, and so forth that perform particular tasks or implement particular abstract data types. The technology herein may also be practiced in distributed computing environments where tasks are performed by remote processing devices that are linked through a communications network. In a distributed computing environment, program modules may be located in both local and remote computer storage media including memory storage devices.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

Claim Support Section

In a first embodiment, an electronic device comprises a display having a plurality of zones, each zone comprising a subpixel matrix configured to display an image in a viewable area of the display; and a processor coupled to the display, the processor configured to: (1) obtain source data for the image to be displayed in the viewable area of the display; (2) analyze the source data in selected zones of the plurality of zones to determine at least one characteristic of the image in each selected zone; and (3) adjust, separately in each zone of the plurality of zones, at least one type of subpixel in the subpixel matrix based on determined characteristics of the image in the selected, analyzed zones.

In a second embodiment, with reference to the first embodiment, the electronic device further comprises a display driver coupled to the processor and the display, the display driver configured to drive varying amounts of power to the subpixel matrix in each zone based on the analysis and the adjustments performed by the processor.

In a third embodiment, with reference to the first embodiment or the second embodiment, the electronic device further comprises a memory coupled to the processor, the memory configured to store at least one lookup table, wherein the processor is further configured to compare the characteristics of the image with the stored lookup table and determine an amount of power to drive to the at least one type of subpixel in each zone.

In a fourth embodiment, with reference to any of embodiments 1-3, the at least one characteristic of the image comprises, for each selected zone, a gray level histogram of the image, content of the image, an application being run, or a combination thereof.

In a fifth embodiment, with reference to the fourth embodiment, the content of the image comprises a color histogram of the image, an identified shape of the image, an identified texture of the image, or a combination thereof.

In a sixth embodiment, with reference to any of embodiments 1-5, the at least one type of subpixel comprises a white subpixel.

In a seventh embodiment, with reference to any of embodiments 1-6, the at least one type of subpixel comprises a combination of red, blue, and green subpixels.

In an eighth embodiment, with reference to any of embodiments 1-7, the at least one type of subpixel comprises a yellow subpixel, cyan subpixel, magenta subpixel, or combination thereof.

In a ninth embodiment, with reference to any of embodiments 1-8, the processor is further configured to calculate and provide a gamma adjustment to the image to be displayed in each zone of the plurality of zones, the gamma adjustments based on the determined characteristics of the image.

In a tenth embodiment, with reference to any of embodiments 1-9, the display comprises a backlight comprising a plurality of planar emission devices distributed over a viewable display area, wherein the plurality of planar emission devices are disposed in a configurable zone arrangement comprising a plurality of zones of the viewable area, each zone of the plurality of zones comprising at least one planar emission device of the plurality of planar emission devices, and wherein the processor is configured to calculate and provide a backlight adjustment by driving each of the multiple planar emission devices in each zone of the plurality of zones at a respective brightness level.

In an eleventh embodiment, with reference to any of embodiments 1-10, the subpixel matrix is a pentile subpixel matrix.

In a twelfth embodiment, a method comprises obtaining, using a processor of an electronic device, source data for an image to be displayed in a viewable area of a display having a plurality of zones; analyzing the source data in selected zones of the plurality of zones to determine at least one characteristic of the image in each selected zone; and adjusting, separately in each zone of the plurality of zones, at least one type of subpixel in the respective zone based on determined characteristics of the image in the selected, analyzed zones.

In a thirteenth embodiment, with reference to the twelfth embodiment, the method further comprises comparing, using the processor, the determined characteristics of the image with at least one lookup table stored in a memory of the electronic device.

In a fourteenth embodiment, with reference to the thirteenth embodiment, the method further comprises determining, using the processor, an amount of power to drive to the at least one type of subpixel in each zone based on the comparison.

In a fifteenth embodiment, with reference to any of embodiments 12-14, the method further comprises calculating, for each zone, a gamma adjustment to the image to be displayed, the gamma adjustment based on the determined characteristics of the image; and providing the gamma adjustment by adjusting power to specific subpixels within the zone.

In a sixteenth embodiment, with reference to any of embodiments 12-15, the method further comprises calculating, for each zone, a backlight adjustment to the image to be displayed; and providing the backlight adjustment by driving multiple planar emission devices of a backlight of the electronic device at brightness level.

In a seventeenth embodiment, with reference to any of embodiments 12-16, adjustments to unselected, unanalyzed zones of the plurality of zones are an average of adjustments made to two or more adjacent, selected and analyzed zones.

In an eighteenth embodiment, with reference to any of embodiments 12-17, the at least one characteristic of the image comprises, for each selected zone, a gray level histogram of the image, content of the image, an application being run, or a combination thereof.

In a nineteenth embodiment, with reference to any of embodiments 12-18, the content of the image comprises a color histogram of the image, an identified shape of the image, an identified texture of the image, or a combination thereof.

What is claimed is:

1. An electronic device comprising:

a display having a plurality of zones, each zone comprising a subpixel matrix configured to display at least a portion of an image to be displayed in a viewable area of the display;

a processor coupled to the display; and a memory coupled to the processor, the memory configured to store a zone arrangement definition and at least one lookup table, wherein the processor is configured to:

obtain source data for the image to be displayed in the viewable area of the display;

analyze the source data in selected zones of the plurality of zones to determine an identified shape of the at least a portion of the image in each selected zone;

compare the identified shape of the at least a portion of the image in each selected zone with the at least one lookup table;

determine an amount of power to drive to at least one type of subpixel in the subpixel matrix in each selected zone based on the comparison in the respective selected zone; and adjust, separately in each selected zone of the plurality of zones, the amount of power to drive to the at least one type of subpixel in the subpixel matrix of the respective selected zone based on the identified shape of the at least a portion of the image in each selected zone.

2. The electronic device of claim 1, further comprising a display driver coupled to the processor and the display, the display driver configured to drive varying amounts of power to the subpixel matrix in each zone based on the analysis and the adjustments performed by the processor.

3. The electronic device of claim 1, wherein the at least one type of subpixel comprises a white subpixel.

4. The electronic device of claim 1, wherein the at least one type of subpixel comprises a combination of red, blue, and green subpixels.

5. The electronic device of claim 1, wherein the at least one type of subpixel comprises a yellow subpixel, cyan subpixel, magenta subpixel, or combination thereof.

6. The electronic device of claim 1, wherein the processor is further configured to calculate and provide a gamma adjustment to the at least a portion of the image to be displayed in each selected zone of the plurality of zones, the gamma adjustments based on the identified shape of the at least a portion of the image in each selected zone.

7. The electronic device of claim 1, wherein the display comprises a backlight comprising a plurality of planar emission devices distributed over the viewable display area, wherein the plurality of planar emission devices are disposed in a configurable zone arrangement comprising a plurality of zones of the viewable area, each zone of the plurality of zones in the configurable zone arrangement comprising at least one planar emission device of the plurality of planar emission devices, and wherein the processor is configured to calculate and provide a backlight adjustment by driving each of the multiple planar emission devices in each zone of the plurality of zones in the configurable zone arrangement at a respective brightness level.

8. The electronic device of claim 1, wherein the subpixel matrix is a pentile subpixel matrix.

9. The electronic device of claim 1, wherein the analysis of the source data comprises applying a segmentation or edge detection to the at least a portion of the image in each selected zone.

10. An electronic device comprising:

a display having a plurality of zones, each zone comprising an array of subpixels configured to display at least a portion of an image to be displayed in a viewable area of the display;

a memory configured to store a zone arrangement definition and at least one lookup table;

a display driver coupled to the display, the display driver configured to drive varying amounts of power to the array of subpixels in each zone; and a processor coupled to the display, the memory, and the display driver, wherein the processor is configured to:

obtain source data for the image to be displayed in the viewable area of the display;

analyze the source data in selected zones of the plurality of zones to determine an identified shape of the at least a portion of the image in each selected zone;

compare the identified shape of the at least a portion of the image in each selected zone with the at least one lookup table stored in the memory;

determine an amount of power to drive to at least one type of subpixel in the array of subpixels in each selected zone based on the comparison in the respective selected zone; and adjust separately in each selected zone of the plurality of zones, in communication with the display driver, the amount of power to drive to the at least one type of subpixel in the array of subpixels in each selected zone of the plurality of zones based on the identified shape of the at least a portion of the image in each selected zone.

11. The electronic device of claim 10, wherein the analysis of the source data comprises applying a segmentation or edge detection to the at least a portion of the image in each selected zone.

12. A method comprising:

configuring a display of an electronic device to have a plurality of zones, each zone comprising a subpixel matrix configured to display at least a portion of an image to be displayed in a viewable area of the display;

storing, in a memory coupled to a processor of the electronic device, a zone arrangement definition and at least one lookup table;

obtaining, using the processor, source data for the image to be displayed in the viewable area of the display;

analyzing, using the processor, the source data in selected zones of the plurality of zones to determine at least an identified shape of the at least a portion of the image in each selected zone;

comparing, using the processor, the identified shape of the at least a portion of the image in each selected zone with the at least one lookup table;

determining, using the processor, an amount of power to drive to at least one type of subpixel in the subpixel matrix in each selected zone based on the comparison in the respective selected zone; and adjusting, separately in each selected zone of the plurality of zones, the amount of power to drive to the at least one type of subpixel in the subpixel matrix of the respective selected zone based on the identified shape of the at least a portion of the image in each selected zone.

13. The method of claim 12, further comprising:

calculating, for each selected zone, a gamma adjustment to the at least a portion of the image to be displayed in the respective selected zone, the gamma adjustment based on the identified shape of the image in each selected zone; and providing the gamma adjustment by adjusting power to specific subpixels within the respective selected zone.

14. The method of claim 12, further comprising:

calculating, for each selected zone, a backlight adjustment to the at least a portion of the image to be displayed; and providing the backlight adjustment by driving multiple planar emission devices of a backlight of the electronic device at brightness level.

15. The method of claim 12, wherein adjustments to unselected, unanalyzed zones of the plurality of zones are determined based on an average of adjustments made to two or more adjacent, selected and analyzed zones.

16. The electronic device of claim 12, wherein the analyzing of the source data comprises applying a segmentation or edge detection to the at least a portion of the image in each selected zone.

* * * * *